US005795179A

United States Patent [19]

Lin

[11] Patent Number: 5,795,179

[45] Date of Patent: Aug. 18, 1998

[54] SOCKET FOR ENERGY-SAVING BULBS

[75] Inventor: Ching-fang Lin, Taipei Hsien, Taiwan

[73] Assignee: Golo Chang Company Limited, Taipei Hsien, Taiwan

[21] Appl. No.: 692,771

[22] Filed: Aug. 6, 1996

Related U.S. Application Data

[63] Continuation-in-part of Ser. No. 536,261, Sep. 29, 1995, abandoned.

[51] Int. Cl.[6] ..... H01R 4/24

[52] U.S. Cl. ..... 439/441; 439/419

[58] Field of Search ..... 439/441, 439, 439/419, 683, 686, 689, 699.2

[56] References Cited

U.S. PATENT DOCUMENTS 4,713,019 12/1987 Gaynor ..... 439/441
4,790,769 12/1988 Ganada ..... 439/441
4,971,567 11/1990 Mizuno et al. ..... 439/441
5,558,543 9/1996 Takano et al. ..... 439/699.2

*Primary Examiner*—Hien Vu
*Attorney, Agent, or Firm*—Oppenheimer Poms Smith

[57] ABSTRACT

A lamp socket for an energy-saving bulb includes a housing integrally formed of a substantial elliptical projection; a cross-shaped projection and a rectangular wall plate formed on a top surface of the elliptical projection for defining four compartments each with a hole in communication with an inner portion of the elliptical projection; four connector racks each received within a corresponding compartment and having a lead receiving portion and a bulb receiving portion; and a table-shaped cap for covering the compartments and having an upper surface with apertures for electric wires connected to the connector racks to extend through thereby preventing interconnection of the lamp socket from causing an electric shock to a user.

6 Claims, 3 Drawing Sheets

SOCKET FOR ENERGY-SAVING BULBS

CROSS-REFERENCE TO RELATED APPLICATION

The present application is a continuation-in-part (CIP) application of application Ser. No. 08/536,261 now abandoned to Lin entitled "Socket for Energy-Saving Bulb" that was filed in the U.S. Patent and Trademark Office on Sep. 29, 1995.

FIELD OF THE INVENTION

The present invention relates to a bulb socket, and particularly to an improved socket for an energy-saving bulb.

RELATED PRIOR ARTS

U.S. Pat. No. 4,618,205, entitled Light Fixture discloses a base 12 adapted to receive a bulb socket 60 without any additional structure to support a bulb 40. Thus, if the energy-saving bulb is applied into the structure, the is end wall might easily be broken by the weight of the bulb.

U.S. Pat. No. 5,008,588, entitled Wedge-Type Lamp Bulb Assembly relates to a lamp socket with a retaining foot 31. However, the foot is too pliable to hold an energy-saving bulb within the socket due to its weight.

SUMMARY OF THE INVENTION

An object of the present invention is to provide a lamp socket for an energy-saving lamp.

Another object of the present invention is to provide a lamp socket having an insulating cap for preventing interconnection thereof from causing an electric shock to a user.

According to the present invention, a socket for an energy-saving bulb includes a housing integrally formed of a substantial elliptical projection with two oppositely-facing long walls and short walls for adapting a base of the bulb. Two wing portions extend from the short walls of a bottom of the projection with an aperture defined in each wing portion. A cross-shaped projection and a rectangular wall plate are formed on a top surface of the elliptical projection for defining four compartments each with a hole in communication with an inner portion of the elliptical projection. Two longitudinal slots are defined against opposite walls of the rectangular wall plate, and four notches are defined in a top edge of the opposite walls. Four connector racks are each received within a corresponding compartment, having a lead receiving portion defining a plurality of resilient retaining pieces on a top surface and a side wall facing the notches. A bulb receiving portion is formed of two oppositely-facing arcuated plates extending downward from the lead receiving portion. A table-shaped cap has a flat surface having a corresponding number of apertures facing the retaining piece on the top surface of the connector racks for covering the compartments, four legs each having a foot for extending into a corresponding slot and engaging within the slot when the cap is mounted onto the cross-shaped projection, and two oppositely faced wall plates each defining four grooves facing the notches under a bottom edge for forming four orifices aligning with retaining pieces when the cap is mounted onto the projection.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
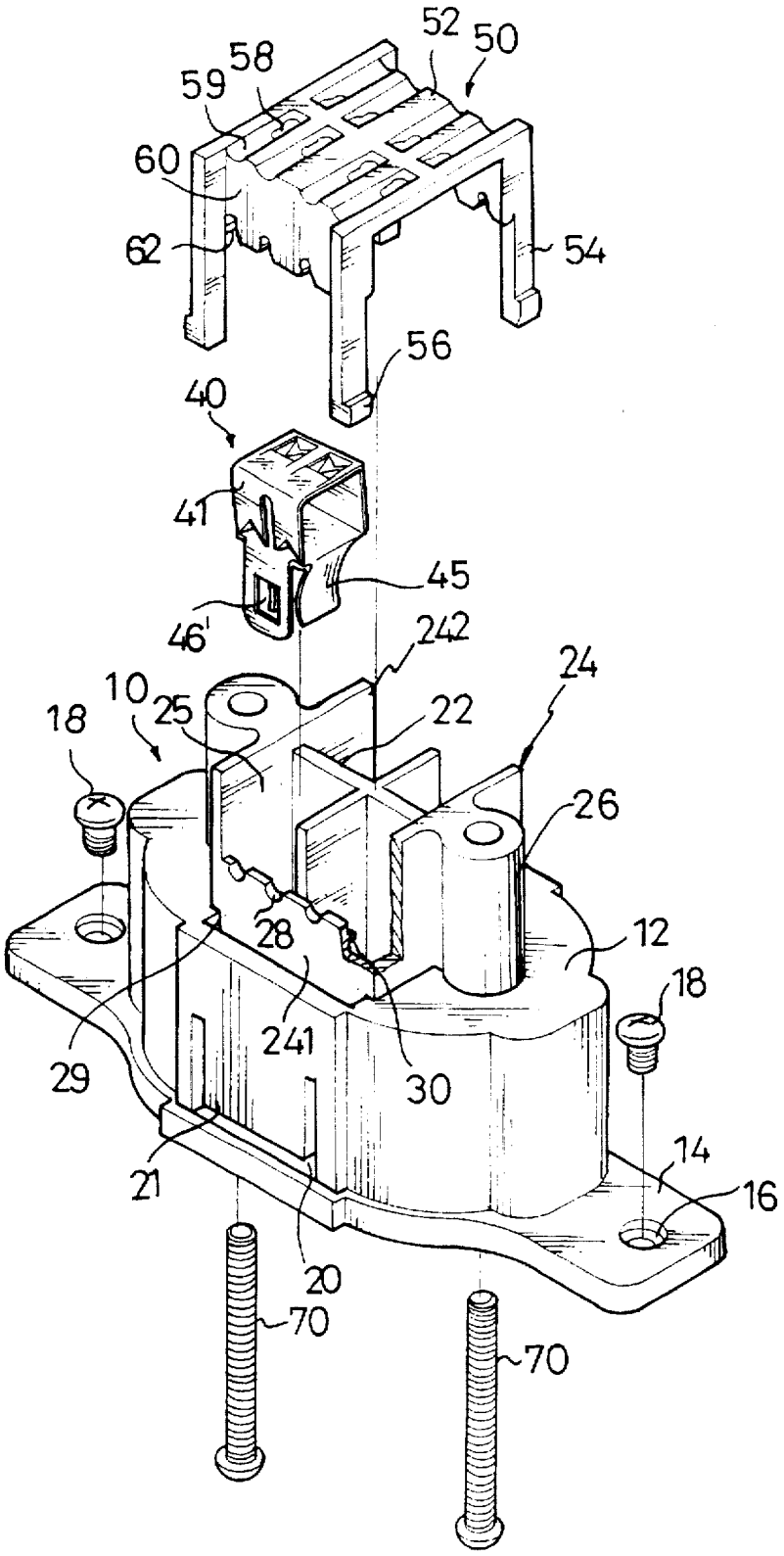
FIG. 1 is an exploded view of a lamp socket of the present invention.
Figure 3:
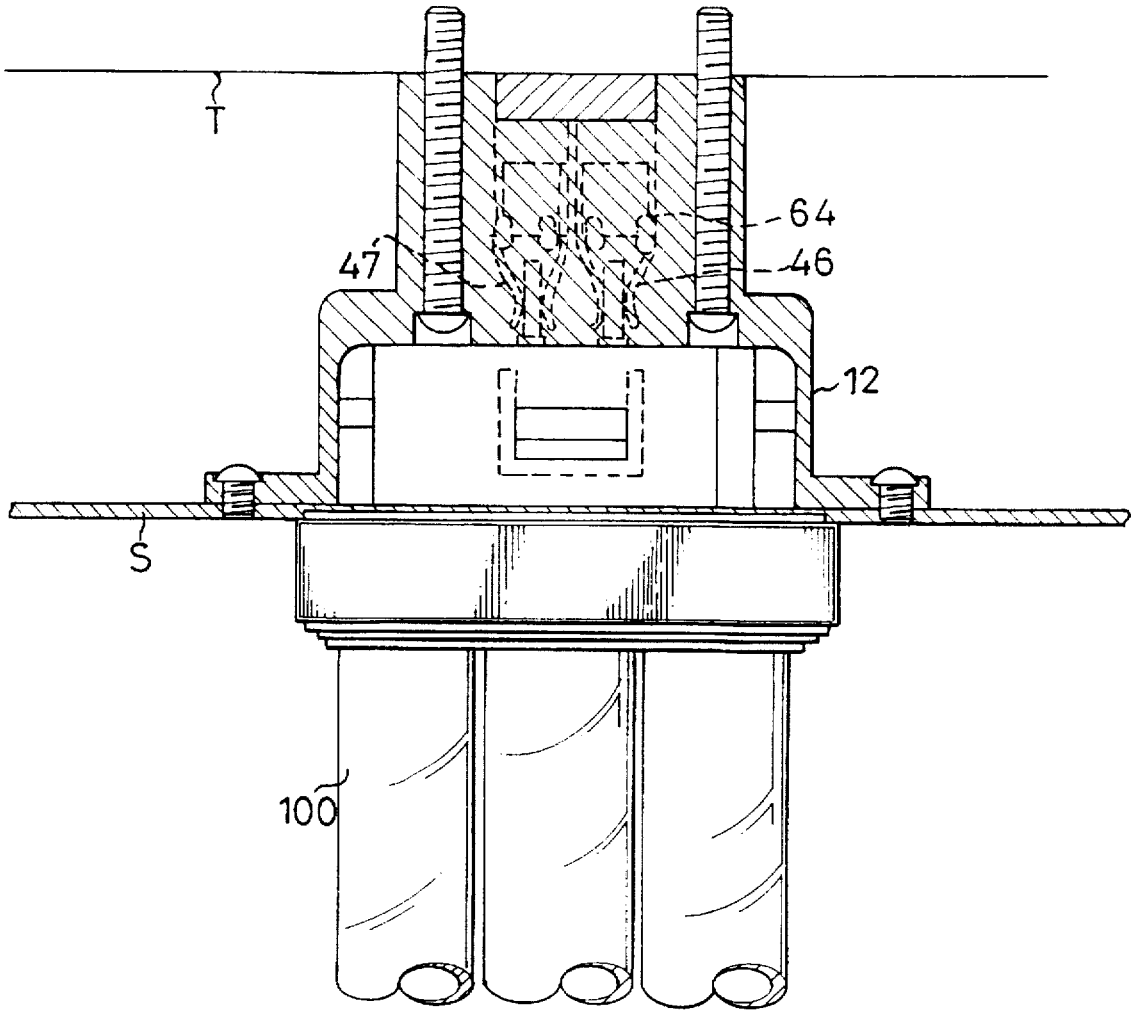
FIG. 3 is a cross-sectional view of the lamp socket in FIG. 1.

Referring to FIG. 1, a lamp socket in accordance with the present invention generally includes a housing 10, four connector racks 40 (only one rack is shown), a table-shaped cap 50, and two screws 70 for securing the lamp socket onto a true ceiling T (in FIG. 3). The housing 10 is integrally formed of a substantially elliptical projection 12 with two oppositely-facing long walls and short walls for receiving a base of a lamp 100 (shown in FIG. 3), two wing portions 14 extending from the short walls of a bottom of the projection 12 with an aperture 16 defined in each wing portion 14 for a screw 18 to extend through and thus mount the lamp socket onto a suspended ceiling S as shown in FIG. 3.

Referring back to FIG. 1, each of the long walls of the projection 12 further has a U-shaped slit 20 to define a departing tooth pieces 21 for facilitating the insertion of the lamp base as mentioned in the applicant's application Ser. No. 08/536,261. A top surface of the projection 12 further defines four holes (not shown) for a corresponding number of terminal pins of the lamp to be inserted therethrough. A cross-shaped projection 22 and rectangular wall plates 24 are formed on the top surface of the projection 12 as to define four compartments 25 each aligned with a hole wherein two longitudinal slots 29 are respectively defined against the long walls 241 of the rectangular wall plates 24, in the top surfaces of the projection 12 the long walls. Two tube-like extensions 26 are integrally formed with the opposite short walls 242 of the rectangular wall plates 24 respectively for the screws 70 to extend through mount the lamp socket to the true ceiling T as mentioned.

As shown, the long walls 241 of the rectangular wall plates 24 have a height smaller than that of the short walls 242 of the rectangular wall plates 24 and four equidistant notches 28 are defined in a top edge of each of the long walls of wall 241 plate 24. A ridge 30 is respectively formed within each compartment 25 on the long wall 241.

The connector rack 40 defines a lead receiving portion 41 and a bulb receiving portion 45 having a recess 46' for engaging with the ridge 30 when the connector rack 40 is received within each compartment 25.

The table-shaped cap 50 has an upper surface 52 for covering the cross-shaped projection 22 and four legs 54 for extending into the slots 29 when the cap 50 is mounted onto the cross-shaped projection 22. Each of the legs 54 further includes a foot 56 for engaging within one of the respective slots 29 when the cap 50 is mounted onto the cross-shaped projection 22. The upper surface 52 of the cap 50 further defines two openings 58 on each of areas corresponding to each compartment 25 for electric wires (not shown) to extend therethrough. As shown in FIG. 1, the upper surface 52 of the cap 50 has eight recesses 59, and the openings 58 are defined in the recesses 59 respectively. Accordingly, an electric wire which is connected to the connector rack 40 can extend through a corresponding opening 58 and be placed in the recess 59. The flat surface 52 of the cap 50 further comprises two downward-extending wall plates 60 facing the long wall of the wall plate 24. Each of the wall plates 60 defines four equidistant grooves 62 thereunder corresponding to the notches 28 in the long wall of the rectangular wall plate 24 as to form four orifices 64 (as shown in FIG. 3 in dashed lines) when the cap 50 is mounted onto the rectangular wall plate 24 for electric wires to extend therethrough.

Figure 2:
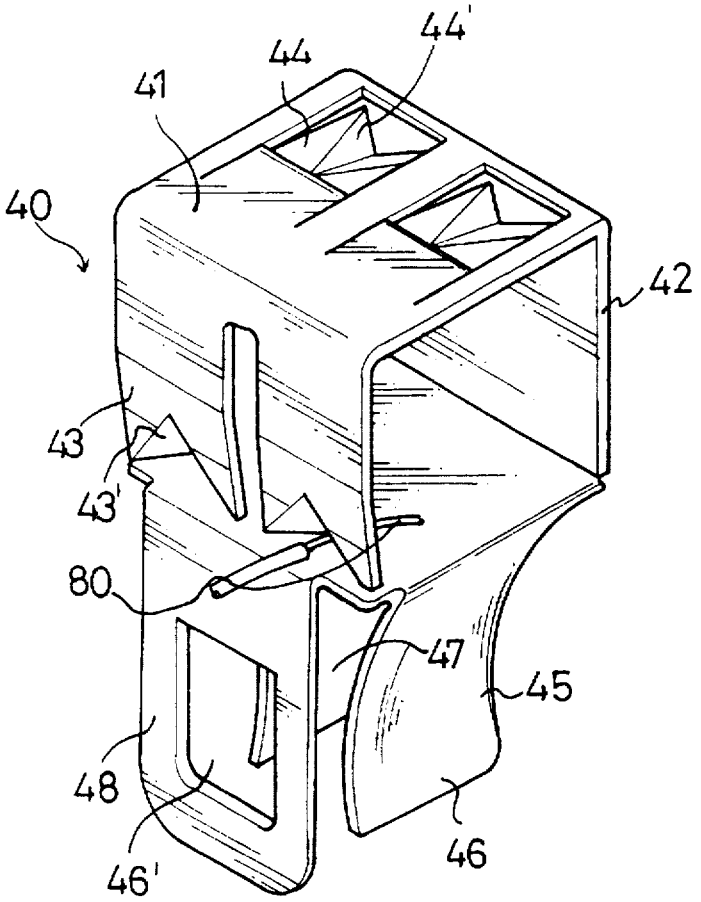
FIG. 2 is a perspective view of a connector rack of the present invention.

Referring to FIG. 2, a detailed structure of the connector rack 40 is shown. The connector rack 40 is preferably formed of a suitable electric conducting plate which is bent to form the lead receiving portion 41 and the bulb receiving portion 45 as mentioned. The lead receiving portion 41 is bent to form a square cross-sectional frame 42 having a top surface, two side walls, and a bottom plate. Two pairs of retaining portions 43 and 44 are respectively formed on a free end of the conducting plate adjacent to the bottom plate and the top surface for conducting electric wires 80 (only one is shown) to be retained thereon. As shown, each of the retaining pieces 43 and 44 includes a tongue portion having two triangular slanted surfaces 43', 44' inclining to an inner portion of the square cross-sectional frame 42.

The bulb receiving portion 45 is formed of two oppositely-facing arcuated plates 46, 47 extending inward and downward from the bottom plate of the frame 42 for electrically connecting with a pin of a bulb, and a fixation plate 48 extending from an edge of the bottom plate adjacent to the tongue 43 with the recess 46' as mentioned.

Referring to FIG. 3, the lamp socket according to the present invention has been mounted between a true ceiling T and a suspended ceiling S. An energy-saving bulb 100 has been inserted into the socket and suspended therewithin by having a tab portion of the bulb 100 to be engaged with the tooth portions of the projection 12 as mentioned in applicant's U.S. patent application Ser. No. 08/536,261. The pins of the bulb 100 have been clamped by the arcuated plates 46, 47.

In the above arrangement, the present invention has achieved the following advantages:

A. As the connector rack 40 is provided with four retaining pieces 43, 44 on the top surface and one of the side walls in cooperation with orifices 64 defined by the cap 50 and the rectangular wall plate 24, it is convenient for a technician to electrically connect the lamp socket to a voltage source or another lamp socket without any risk of electric shock.

B. As the connector rack 40 is formed of a bent electrically-conducting plate, the manufacture procedure thereof has been reduced and the connector rack 40 is also easily inserted into the compartment.

C. As the flat surface of the table shaped cap 50 is provided with the channel 59, the possible short-circuit situation of the electric wires being connected to the connector racks 40 will be diminished. The electric wires will be fixedly secured within the channels.

D. The table-shaped cap 50 has legs 54 to extend into the slots 29 and feet 56 to engage with an inner wall of the projection 12, thus, the cap 50 is tightly mounted onto the rectangular wall plate 24.

E. As the screws 70 are threaded into the true ceiling T via the tubes 26 and the screws 18 are threaded into the suspended ceiling S via the apertures 16 on wing portions 14, the lamp socket of the present invention can be fixedly secured.

Although the invention has been explained in relation to its preferred embodiment, it is to be understood that many other possible modifications and variations can be made without departing from the spirit and scope of the invention as hereinafter claimed.

I claim:

1. A lamp socket for an energy-saving bulb, comprising:

a hollow housing integrally formed of a substantially elliptical projection with two oppositely-facing long walls and short walls for adapting a base of the bulb, two wing portions extending from the short walls of a bottom of the projection with an aperture defined in each wing portion.a cross-shaped projection and rectangular wall plates having a pair of opposite long walls and a pair of opposite short walls formed on a top surface of the elliptical projection for defining four compartments each with a hole in communication with an inner portion of the elliptical projection, two longitudinal slots defined in opposite walls of the rectangular wall plates, two U-shaped slits respectively defined on long walls of the substantial elliptical projection, and four notches defined on a top edge of each of opposite walls of said rectangular plates;

four connector racks each to be received within a corresponding compartment, having a lead receiving portion and a bulb receiving portion, said lead receiving portion having a plurality of resilient retaining pieces defined in a top surface and a side wall facing the notches and said bulb receiving portion being formed of two oppositely-facing arcuated plates extending inward and downward from the lead receiving portion; and a table-shaped cap comprising a flat surface having a plurality of openings facing the retaining on the top surface of the connector racks for covering the compartments, four legs extending from said flat surface, each having a foot for extending into a corresponding slot and engaging within the slot when the cap is mounted onto the cross-shaped projection, two oppositely faced wall plates connected to said four legs, each having four grooves under a bottom edge and facing the notches for defining four orifices aligning with retaining pieces when the cap is mounted onto the projection.

2. A lamp socket according to claim 1 wherein each of said connector racks further comprises a fixation plate extending from the lead receiving portion and defining a recess, and each of said compartment is provided with a ridge on an inner wall of each compartment for securing a respective connector rack within the compartment by having the ridge engaged within the recess.

3. A lamp socket according to claim 2 wherein each of said retaining pieces includes a tongue portion defining two triangular slanted surfaces.

4. A lamp socket according to claim 1 wherein said connector rack is formed of an electric conducting plate and bent to form the lead receiving portion and the bulb receiving portion.

5. A lamp socket according to claim 1 wherein each of said openings on the table-shaped cap is further provided with a channel extending out of the flat surface.

6. A lamp socket according to claim 1 wherein said housing further defines two tube-like projections integrally formed with the short walls of the rectangular wall plates respectively.

* * * * *